US007316338B2

(12) United States Patent
Botham et al.

(10) Patent No.: US 7,316,338 B2
(45) Date of Patent: Jan. 8, 2008

(54) DEVICE FOR DISCHARGING MOLTEN METAL FROM A CONTAINER

(75) Inventors: Brian W. Botham, Sheffield (GB); Gianni Zomero, Pasian di Prato (IT); Andrea De Luca, Remanzacco (IT)

(73) Assignee: Danieli & C. Officine Meccaniches S.p.A., Buttrid (IT)

( * ) Notice: Subject to any disclaimer, the term of this patent is extended or adjusted under 35 U.S.C. 154(b) by 420 days.

(21) Appl. No.: 10/520,602

(22) PCT Filed: Jul. 7, 2003

(86) PCT No.: PCT/EP03/07241

§ 371 (c)(1),
(2), (4) Date: Jan. 7, 2005

(87) PCT Pub. No.: WO2004/007123

PCT Pub. Date: Jan. 22, 2004

(65) Prior Publication Data

US 2005/0279782 A1 Dec. 22, 2005

(30) Foreign Application Priority Data

Jul. 10, 2002 (IT) ..... MI2002A1507

(51) Int. Cl.
*B22D 41/08* (2006.01)

(52) U.S. Cl. ..... 222/606; 222/607; 164/335

(58) Field of Classification Search ..... 222/606, 222/600, 607; 164/335
See application file for complete search history.

(56) References Cited

U.S. PATENT DOCUMENTS

| | | | | |
|---|---|---|---|---|
| 3,608,616 | A | | 9/1971 | Schneider |
| 3,833,050 | A | | 9/1974 | Kashuba et al. |
| 4,840,297 | A | | 6/1989 | Weekley et al. |
| 4,875,712 | A | * | 10/1989 | Oda et al. ..... 285/47 |

FOREIGN PATENT DOCUMENTS

| | | |
|---|---|---|
| FR | 2 659 880 | 9/1991 |

* cited by examiner

*Primary Examiner*—Scott Kastler
(74) *Attorney, Agent, or Firm*—Sampson & Associates, P.C.

(57) ABSTRACT

An discharging device for molten metal between an upper ladle (1) and a tundish (3) comprising a slide valve nozzle fixed to the base of the ladle, comprising an upper fixed nozzle (42) and a mobile one below (43), inserted into an opening in the base of said slide valve nozzle with the lower end protruding from it, and a ring shaped blade (46) fixed to the base of the slide valve nozzle around said aperture. The tundish (3) comprises a cylindrical jacket (22) placed with a vertical axis and fitted at its end with a sand joint (24) for sealing gas into which the ring shaped blade is sunk (46). The slide valve nozzle can be fixed to the base of the ladle by mountings (48, 49) fitted with eyelets into which pivots (50) are inserted.

7 Claims, 6 Drawing Sheets

DEVICE FOR DISCHARGING MOLTEN METAL FROM A CONTAINER

This application claims priority to PCT/EP2003/007241 entitled Device For Discharging Molten Metal From A Container, filed on 7 Jul. 2003, which claims priority to Italian Patent Application No.MI2002A001507, filed on 10 Jul. 2002.

FIELD OF THE INVENTION

The invention refers to an discharging device for molten metal from one container to another, from example from a ladle to a tundish or from a tundish to an under tundish for feeding a continuous casting line.

BACKGROUND ART

Normally, in continuous casting plants, the molten metal produced, for example from an electric furnace, or from a converter, is subjected to a series of pouring passages between containers, prior to being cast in the ingot mould to form ingots, slabs, bars, strips and others.

A typical example is given by the application of the technology of continuous strip casting in which the steel coming from the production oven is collected in a ladle, from which it is unloaded into one or more tundishes, each of which feeds one or more melts above two cooled, counter rotating crystallising rolls, which constitute the ingot mould in which the metal solidifies and exits in the form of finished product, for example a strip, a bar or otherwise. Between the tundish and the ingot mould there can also be provided an under tundish, or another discharging device, from which the liquid metal is dosed into the ingot mould.

It is known that the quality of the final product, and also the execution of the process itself can be compromised by the contact of air with the molten metal. For example, the oxygen in the air can combine with elements dissolved in the steel forming inclusions, which deteriorate the quality of the steel, as also with dissolved oxygen itself. In case the steel is used in continuous casting, for example in a dual roller plant, the oxygen combined with the iron can produce scale which deposits on the rollers, locally altering, amongst others, the heat exchange, with serious consequences for the final product. Nitrogen can also provoke the formation of precipitates which compromise the quality of the product.

In the containers into which the molten metal passes, there is generally maintained a protective atmosphere, generally through the feeding of an inert gas, for example argon.

The various passages of the metal from one container to another are critical, with regard to the problem of possible contamination with air, bearing also in mind that the various containers must be emptied in between, both for the normal movement during the metal production operation, as for example in the case of the tundishes, and to allow for the substitution of the parts in refractory material, such as, for example the discharging sleeves or tubes through which the molten metal flows, subject to rapid wear and corrosion.

Discharging devices in the known art are not easy to operate and require delicate operations to allow the approaching of two containers for joining. Sometimes the impacts produced during the coupling damage the parts of the discharging device. Therefore, the need is felt of providing discharging devices, to interpose between the various containers in which the molten metal passes, avoiding contact between the air and the metal and allowing a rapid and precise coupling between the containers, in addition to a likewise rapid uncoupling.

SUMMARY OF THE INVENTION

It is therefore an aim of the present invention, to overcome the above mentioned drawbacks by providing a device for the discharging of molten metal from a container which permits a rapid and precise coupling of the container and another container, so as to constitute a conduit for the passage of the molten metal avoiding the contact of the metal with the air.

A further aim is that of realising a discharging device which permits a rapid, reliable and lasting coupling of two containers, in the presence of molten metal at high temperature and which in addition is not prone to the impacts which can occur during the coupling operation of the containers.

The above problems have been solved in accordance with the main claim by means of a discharging device for molten metal between a first upper container and a second container placed below the first, comprising a slide valve nozzle comprising an upper and lower nozzle, movable with respect to the upper, a circular blade, fixed to the base of the slide valve nozzle around a molten metal discharging aperture, said lower nozzle being inserted into said aperture with the lower end protruding from it, and comprising a cylindrical jacket placed with the vertical axis and fitted at its upper end of means for sealing gas which couple with said circular blade and surround the lower end of the lower nozzle in operation, said cylindrical jacket being fixed above said second container.

According to a further aspect of the invention the previously cited problems are solved by a method of coupling, by means of a device as described above, of a first container to which there is fixed the slide valve nozzle and which is filled with molten metal placed at a superior level with a second container placed at a lower level than the first comprising:

a) putting in an operating position said second container for accepting molten metal from the first container;

b) coupling the first container in a predetermined position on said second container by way of a movement comprising a descending component, so as to make the circular blade sink into the gas restraining means.

LIST OF THE FIGURES

Further advantages of the present invention will become apparent, to the skilled person, from the following detailed description of an embodiment of a discharging device described by way of non limiting example with reference to the following figures, of which:

DETAILED DESCRIPTION OF A PREFERRED EMBODIMENT

Figure 1:
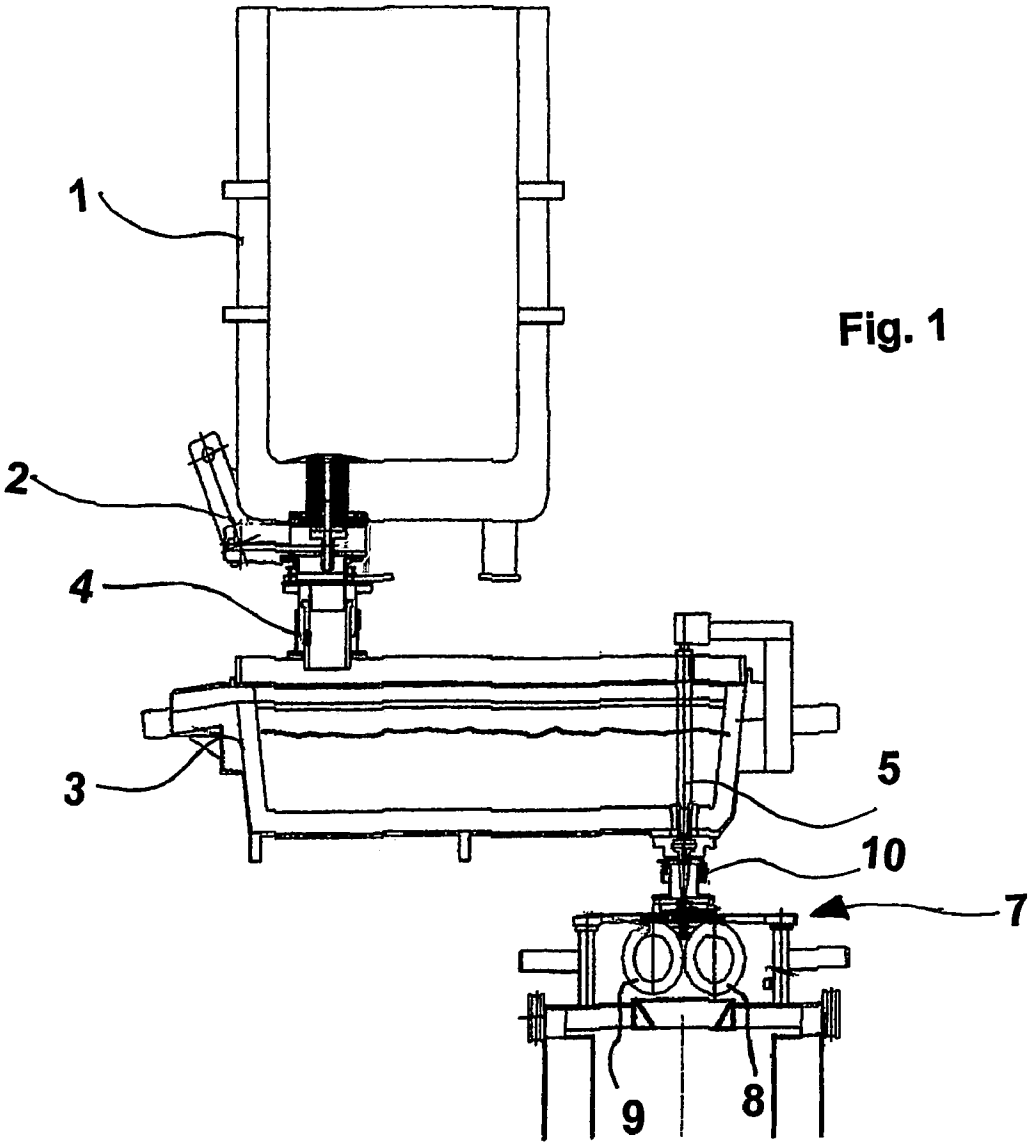
FIG. 1 shows the schematic view of a vertical section of a production plant for steel strips and slabs by continuous casting.

FIG. 1 shows schematically an example of a production plant for steel strips and slabs with a fusion process by continuous casting.

The molten steel, or other bath of liquid metal, from the ladle 1 is poured, through a first box device 2 and a first discharging device 4, also defined as "pour box", into the tundish 3.

From the tundish 3 the melt is discharged, regulated or with a buffer shaft 5, or with a slide valve nozzle—and through the second discharging box or "pour box" 10—into the under tundish 6, and from here into the ingot mould formed by the counter rotating casting rolls 7. From the ingot mould there is produced the strip of indefinite length realising the continuous casting process. It is clear that by means of another kind of ingot mould, the plant can produce other metallic products, such as slabs, billets, blooms etc.

Figure 2:
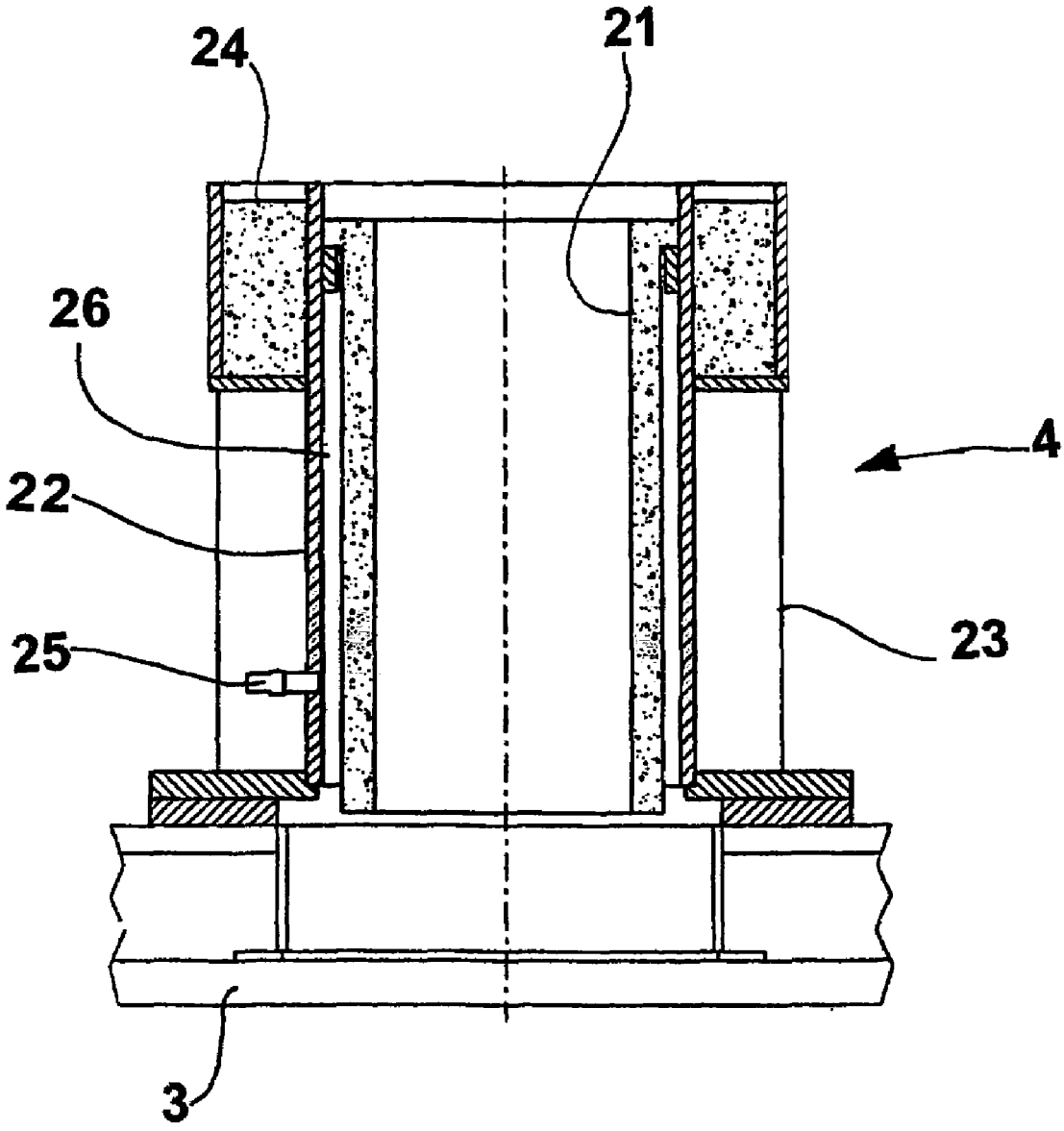
FIG. 2 shows an enlarged section of the discharging device according to the invention.

FIG. 2 shows an example of a preferred embodiment of the present invention in which the lower part—indicated collectively by reference 20—of the discharging device 4 of FIG. 1.

The lower part 20 comprises a tube in refractory material 21 enclosed and supported by a jacket or cylindrical structure of welded steel 22, reinforced with appropriate ribbing 23; preferably between the cylindrical jacket 22 and the refractory tube 21 there is provided a hollow space 26 filled with inert gasses, with a function of thermal isolation, amongst others.

In FIG. 2 the lower part 20 of the discharging device 4, herein afterwards referred to also as lower device 20, is represented already fixed to the cover of the tundish 3.

The upper part of the cylindrical jacket 22 defines an annular container filled with sand so as to make the lower part of a sand joint 24.

In the lower part of the cylindrical jacket 22 there is inserted the coupling of a conduit for the admission of inert gasses into the hollow space 26.

Figure 3:
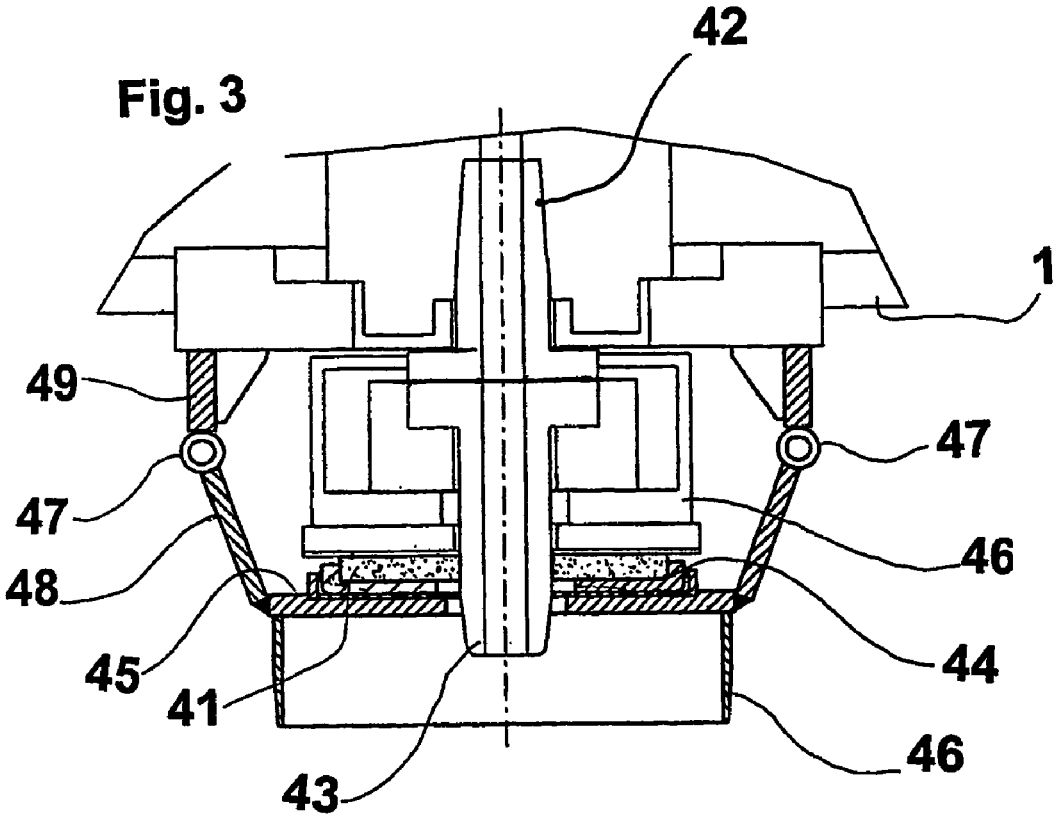
FIG. 3 shows schematically a partially sectioned front view, of the upper part of the device of FIG. 2.
Figure 4:
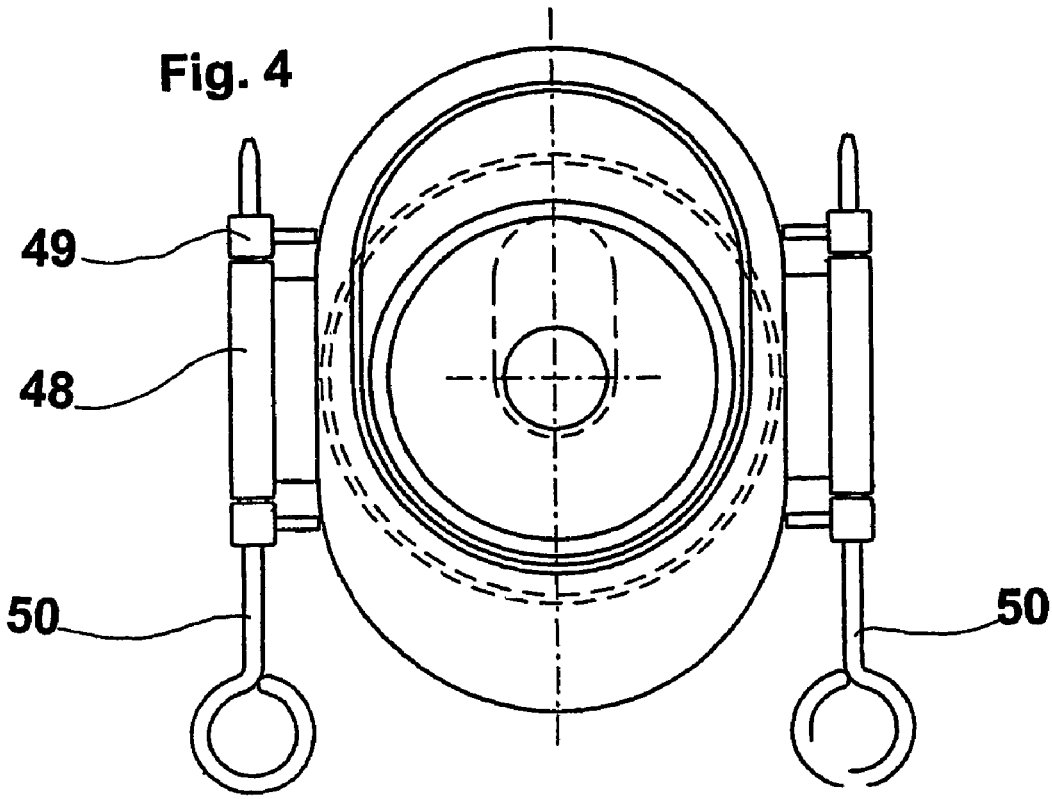
FIG. 4 shows schematically a view from above of a detail of the upper part of the device of FIG. 3.

FIGS. 3, 4 relate to the upper parts of the discharging device 4, with the sand joint and the box of the ladle.

The device 4 illustrated in the FIGS. 2-4 is of the two plate type, where the lower plate 41 is mobile with respect to the ladle 1.

The assembly of FIG. 3 comprises the upper nozzle 42 of the slide valve nozzle, fixed—for example cemented—to the refractory coating of the ladle 1.

The upper nozzle 42 is in contact with the lower nozzle 43, which can abut against the nozzle 42, dragging the lower refractory plate 41, which rests on a steel plate 44 with vertical edges. The lower nozzle 43 can be moved with appropriate means such as a hydraulic cylinder, so as to align the lumen with that of the upper nozzle 42, opening a passage for the molten metal, or to reciprocally hide the ducts, so as to close the passage, thus regulating the delivery.

The lower nozzle 43 is rested on a refractory block 41 rested in turn on the plate 44, which follows the movements of the lower nozzle 43, running on the fixed plate 45, preferably in a precise housing found on said plate 45.

On the lower side of the fixed plate 45 there is welded a circular blade 46, which constitutes the second element of the sand joint 24.

Advantageously, the fixed plate 45 is fixed to the ladle 1 with a connection of moving pivots 47: the two lower mountings 48 are made of two steel plates which define two eyelets; analogous eyelets are defined by the superior mountings 49; it is possible to align the two pairs of eyelets and insert the pairs of pivots 50 into them so as to make two hinge junctions, an operation which can be carried out manually or automatically with appropriate machines.

Figure 5:
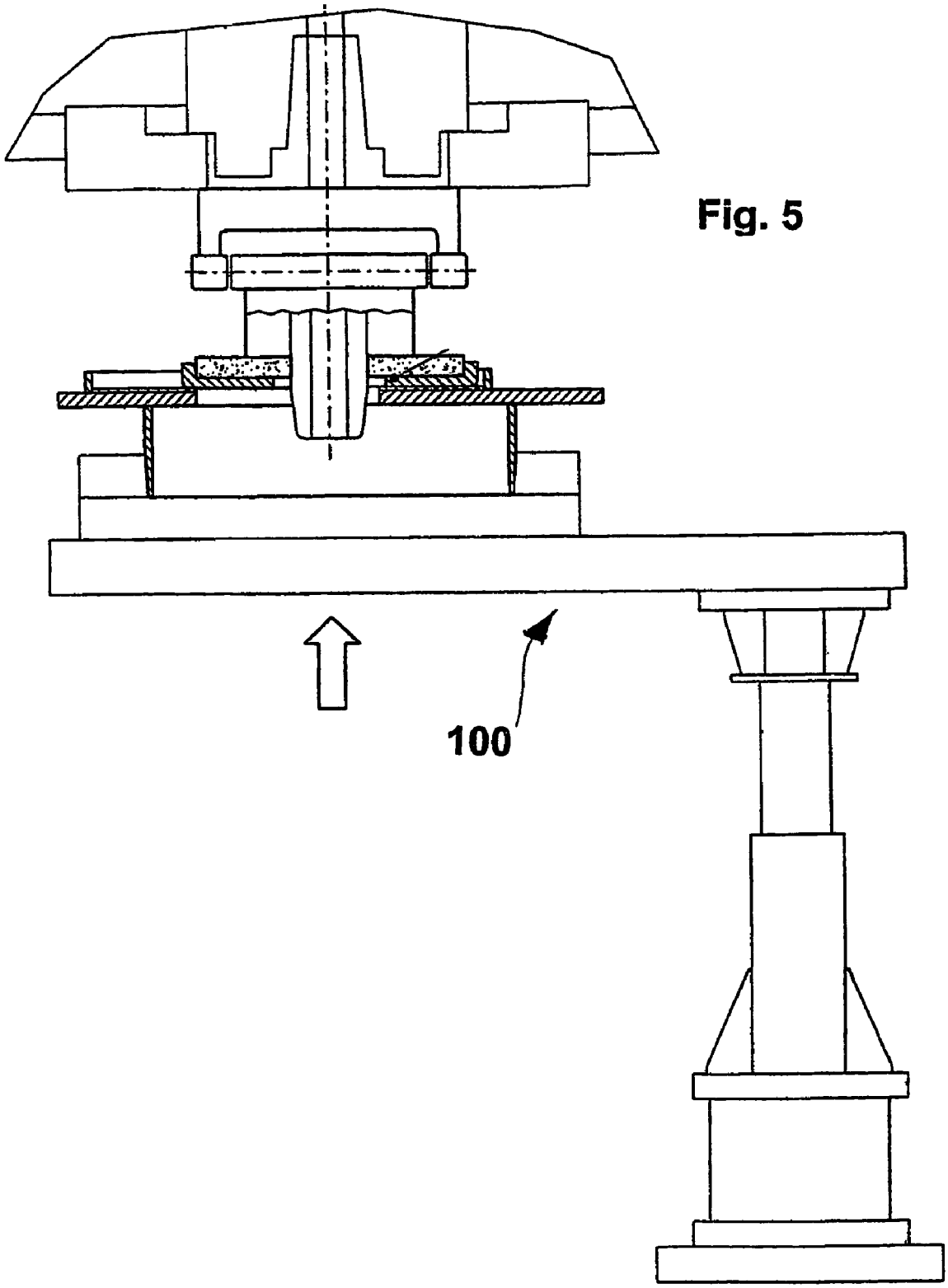
FIGS. 5, 6, 7 show different stages of a preferred mounting sequence of the device of FIG. 2.
Figure 6:
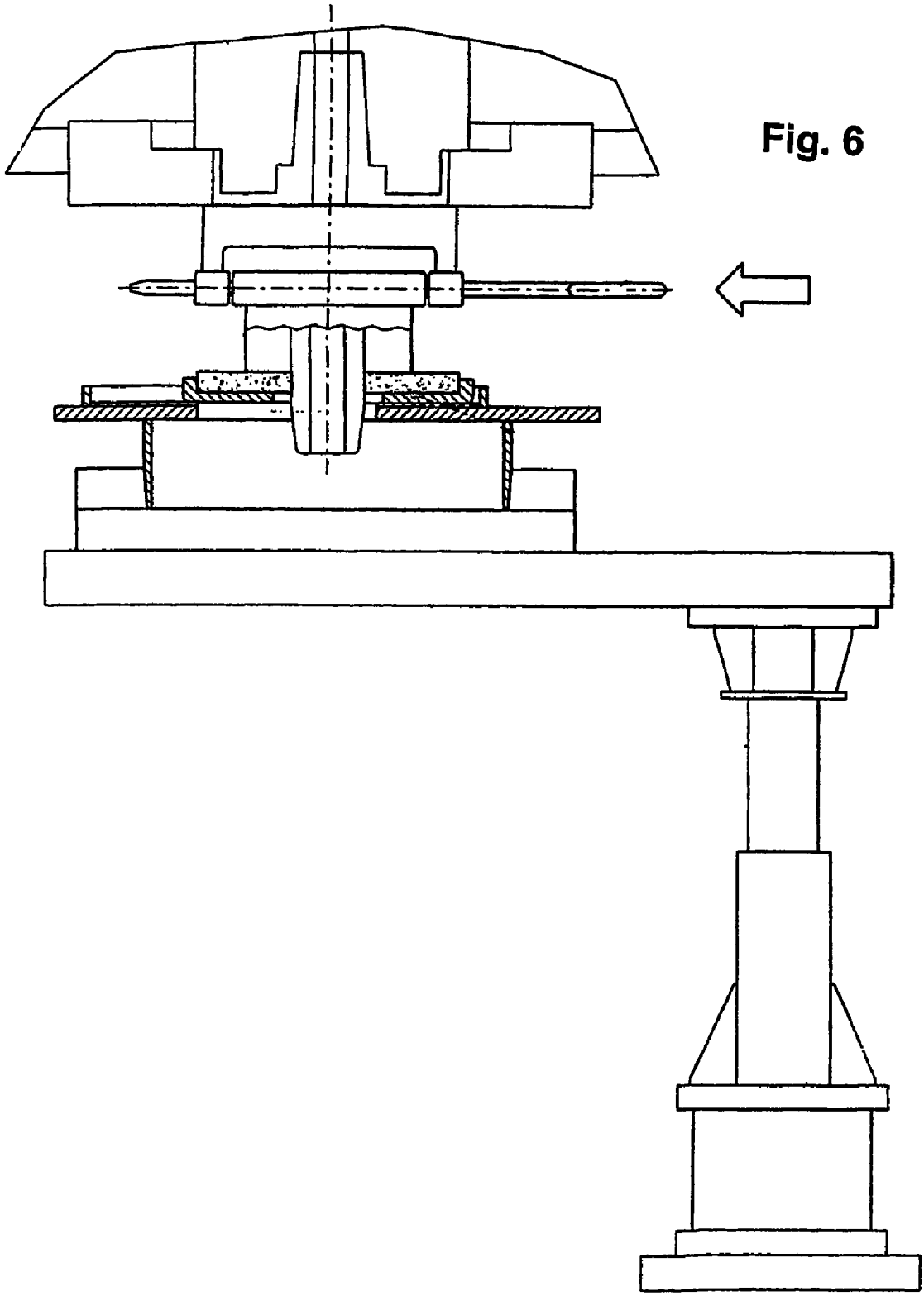

With reference to the FIGS. 5, 6 there is described a preferred mounting sequence of the slide valve nozzle of the ladle 4.

The upper part of the device according to the invention, i.e. the slide valve nozzle is loaded onto the raising platform 100, for example by hydraulic means.

The platform 100 is raised so as to couple the upper part of the device with the superior mountings 49 fixed to the base of the ladle 1 (FIG. 5).

Successively (FIG. 6) the pivots 50 are pushed into the eyelets aligning the mountings 48, 49. The raising platform 100 is then removed.

Figure 7:
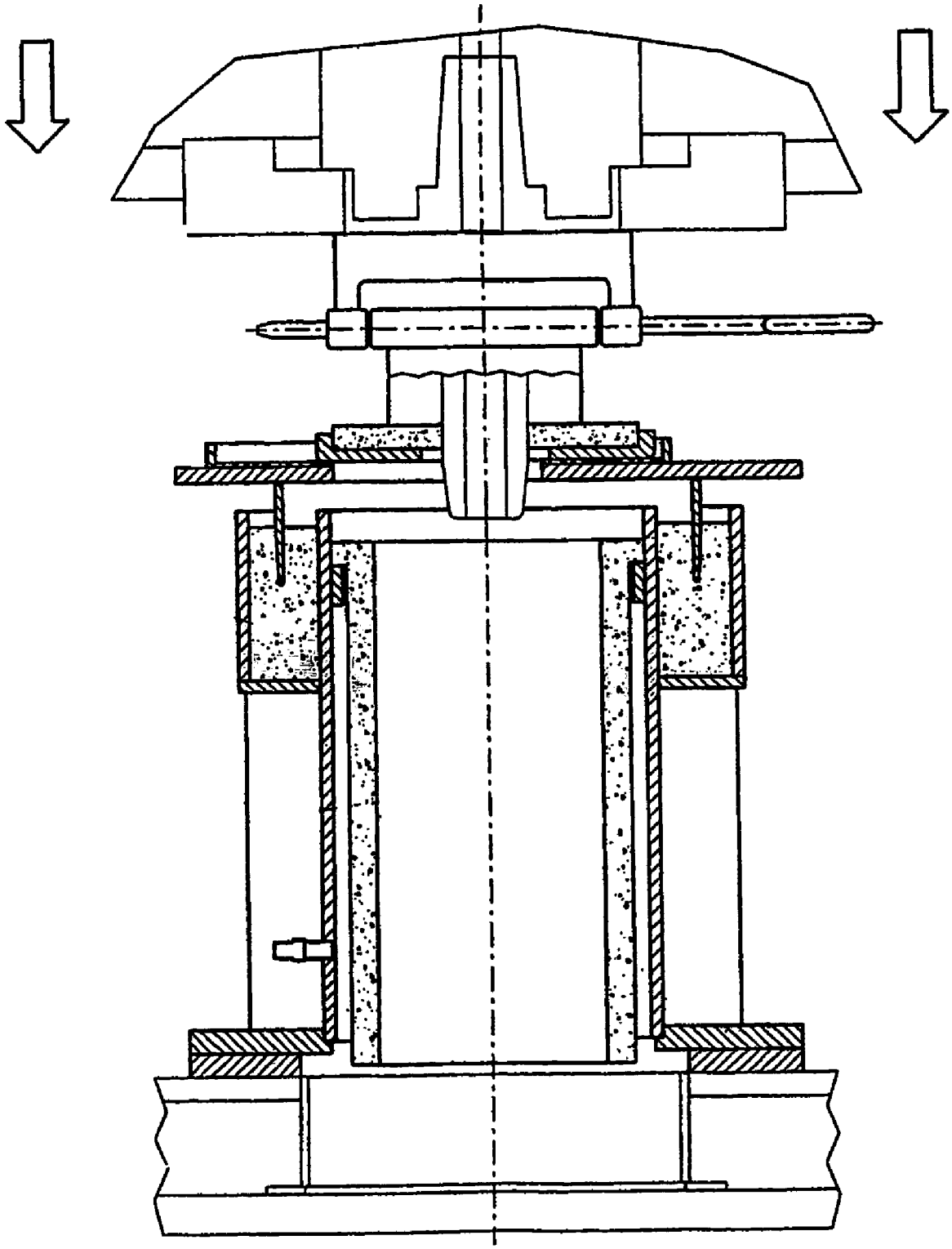

The ladle can be lowered onto the tundish in the casting position (FIG. 7), so as to push the circular blade 46 and make it sink into the sand of the sand joint 24, so as to ensure a satisfactory gas seal.

The invention claimed is:

1. Molten metal discharging device between a first upper container (1) and a second lower container (3), the device comprising a slide valve nozzle comprising an upper (42) and a lower (43) nozzle, the lower nozzle being movable with respect to the upper one, a circular blade (46), fixed to the base of the slide valve nozzle around a molten metal discharging aperture, said lower nozzle being inserted into said aperture with the lower end protruding from it, the discharging device comprising also a cylindrical jacket (22) defining a vertical axis and having at its upper end gas sealing means (24) adapted to be coupled to said circular blade (46) and adapted to surround the lower end of the lower nozzle (43) in operation, said cylindrical jacket (22) being fixed above said second container.

2. The device according to claim 1 wherein a tube (21) of refractory material is inserted inside said cylindrical jacket (22).

3. The device according to claim 1 wherein said slide valve nozzle is able to be coupled to the base of the first container (1) with mountings (48, 49) fitted with eyelets able to receive pivots (50).

4. The device according to claim 1 wherein there are provided means for moving said lower nozzle (43) with respect to the upper nozzle (42) so as to regulate a liquid metal flux through the slide valve nozzle.

5. The device according to claim 1 wherein said gas sealing means comprise an upwardly open toroidal container adapted to be filled with sand into which said circular blade (46) is sunk during operation.

6. The device according to claim 1 wherein there are provided means for injecting inert gasses into said cylindrical jacket (22).

7. Coupling method for containers, by means of a device according to claim 1, wherein there is provided a first container (1) placed at a level above a second container (3) and filled with molten metal, with the slide valve nozzle fixed to said first container (1), comprising:

a) putting in an operating position said second container (3) to receive molten metal from the first container (1);

b) coupling said first container (1) in a predetermined position on said second container (3) by way of a movement comprising a descending component, so as to sink the circular blade (46) into the gas sealing means (24).

* * * * *